United States Patent [19]

Jörss et al.

[11] Patent Number: 4,757,847

[45] Date of Patent: Jul. 19, 1988

[54] FILLING MACHINE FILLING ELEMENT HAVING NO FILLING TUBE

[75] Inventors: Norbert Jörss, Neutraubling; Alfred Rentel, Bad Kreuznach-Winzenheim, both of Fed. Rep. of Germany

[73] Assignee: Seitz Enzinger Noll Maschinenbau AG, Bad Kreuznach, Fed. Rep. of Germany

[21] Appl. No.: 14,623

[22] Filed: Feb. 13, 1987

[30] Foreign Application Priority Data

Feb. 22, 1986 [DE] Fed. Rep. of Germany ..... 3605748

[51] Int. Cl.[4] ..... B65B 31/00

[52] U.S. Cl. ..... 141/198; 141/6

[58] Field of Search ..... 141/1–12, 141/37–70, 192–229, 285–310

[56] References Cited

U.S. PATENT DOCUMENTS 4,509,565 4/1985 Ahlers ..... 141/39

4,572,253 2/1986 Farmer et al. ..... 141/95

*Primary Examiner*—Mark J. Thronson

*Attorney, Agent, or Firm*—Becker & Becker, Inc.

[57] ABSTRACT

A filling element for filling machines, with the filling element having no filling tube and serving for filling bottles, cans, or similar containers with carbonated or non-carbonated liquids. The filling element includes a signal emitter for detecting the designated filling height in a container that is pressed onto the filling element and is to be filled. The signal emitter cooperates with a vertical bore that is disposed in the filling element coaxial to a container seal thereof, and is protected from the entry of liquid from the liquid guidance conduit of the filling element. The signal emitter is part of a measuring device which, when the designated filling height is detected, transmits a signal that triggers closing of the liquid flow valve of the filling element. The measuring device, in order to detect the designated filling height in a non-contact manner, is embodied to operate with pulses that are directed onto the surface of liquid in a pressed-on container, and are reflected from this liquid surface. The vertical bore has an end facing a pressed-on container, with the signal emitter being disposed above this end, i.e. on that side thereof remote from the container. The vertical bore serves not only for use by the signal emitter to react to the designated filling height, but also for use for the supply of gas to, and the withdrawal of gas from, a pressed-on container.

12 Claims, 3 Drawing Sheets

FILLING MACHINE FILLING ELEMENT HAVING NO FILLING TUBE

BACKGROUND OF THE INVENTION

1. Field of the Invention

The present invention relates to a filling element for filling machines, with the filling element having no filling tube and serving for filling bottles, cans, or similar containers with carbonated or non-carbonated liquids. The filling element includes a signal emitter for detecting the designated filling height in a container that is pressed onto the filling element and is to be filled. The signal emitter cooperates with a vertical bore that is disposed in the filling element coaxial to a container seal thereof, and is protected from the entry of liquid from the liquid guidance conduit of the filling element. The signal emitter is part of a measuring device which, when the designated filling height is detected, transmits a signal that triggers closing of the liquid flow valve of the filling element.

2. Description of the Prior Art

Filling elements of the aforementioned general type that have no filling tube are provided with a signal emitter that is responsive to the liquid level that is rising in the pressed-on container to the designated filling height for the purpose of triggering the closure pulse for the liquid flow valve of the filling element. A filling element of this general type is known, for example, from U.S. Pat. No. 4,509,565 Ahlers dated Apr. 9, 1985, which belongs to the assignee of the present application. This filling element is intended for single-chamber and multi-chamber counter pressure filling machines, and includes a signal emitter that is in the form of a switching member and reacts to conductive liquids. This signal emitter is part of a measuring device and is to be introduced into the container that is to be filled as the latter is raised into the filling position. This signal emitter is coaxial to the container seal of the filling element and is vertically and exchangeably inserted into a bore provided in an extension. The extension, which is fixedly provided in the liquid guidance conduit that extends downwardly from the valve seat of the liquid flow valve of the filling element, is provided on its container end with a guide element in the form of a deflector that keeps the liquid that is flowing downwardly in the liquid guidance conduit from the signal emitter as the liquid leaves the liquid guidance conduit. To adjust the filling element to a different designated filling height, for example when the type of container is changed, it is necessary to replace the signal emitter with a different one. Since a filling machine has a number of filling elements, exchanging the signal emitters entails a lot of time and hence leads to a drop in production. A further drawback is that when the signal emitter reacts to the designated filling height, it becomes wetted with liquid, which can lead to bacteriological contamination of the signal emitter.

Another filling element of the aforementioned general type is known from U.S. Pat. No. 3,799,219 uth el al dated Apr. 9, 1974, which also belongs to the assignee of the present application, and has a signal emitter that is disposed within a vertical bore that is centrally disposed in the valve body of the liquid flow valve of the filling element; this signal emitter is to be introduced into a container that is to be filled and that has been placed in a sealed position with the container seal of the filling element. This signal emitter also responds to conductive liquids and, via a lifting mechanism attached to the signal emitter, is lowered from an upper position within the bore of the vlve body to the designated filling height in the container that is in the sealed position. In this position, which is limited by an exchangeable intermediate piece associated with the lifting mechanism, the liquid that is flowing downwardly in the liquid guidance conduit of the filling element is kept from the signal emitter by an extension that is in the form of a guide element and extends downwardly from the sealing element of the valve body. After the signal emitter responds to the liquid that has risen to the designated filling height, the lifting mechanism raises the signal emitter into the upper position. With this filling element, when it is necessary to readjust the latter to a different designated filling height, it is no longer necessary to exchange the signal emitter due to the fact that the latter is adjustable via the lifting mechanism and the intermediate pieces. However, this adjustability represents a considerable capital investment that makes the filling element more expensive. Furthermore, to adjust each filling element to a different designated filling height, the aforementioned adjustability requires exchange of the intermediate piece that limits the lowering movement of the signal emitter.

It is therefore an object of the present invention to improve the filling elements of the aforementioned general type in such a way that it is now possible to eliminate the previously required adjustment, at the filling elements, of the signal emitter to the designated filling height, and hence to eliminate the considerable capital expenditure required for the filling elements, as well as to eliminate the direct response contact of the signal emitter with the liquid with which the respective container has been filled.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
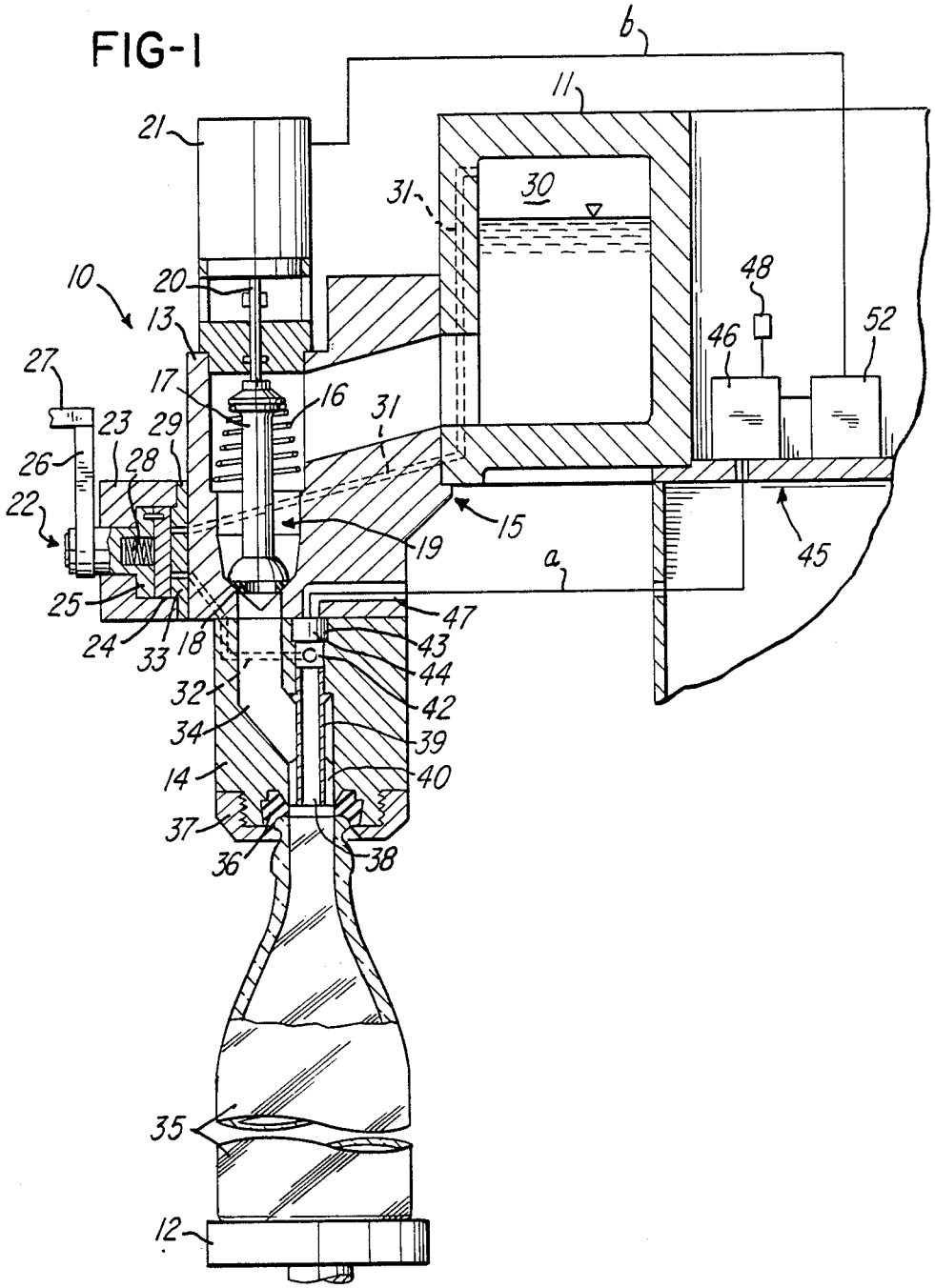
FIG. 1 is a view that illustrates one exemplary inventive embodiment of a filling element having no filling tube, with the filling element having a gas conduit, which is fixedly disposed in the liquid guidance conduit, and a measuring device, including a signal emitter.

The filling element of the present invention is characterized primarily in that the measuring device, in order to detect the designted filling height in a non-contact manner, is embodied to operate with pulses that are directed onto the surface of the liquid in a pressed-on container, and are reflected from this liquid surface, and in that the vertical bore has an end facing a pressed-on container, with the signal emitter being disposed above this end, i.e. on that side thereof remote from the container, with the vertical bore serving not only for use by the signal emitter to react to the designated filling height, but also for use for the supply of gas to, and the withdrawal of gas from, a pressed-on container.

In order to also be able to use the present invention for a filling element having an extension that is fixedly disposed in the liquid guidance conduit of the filling element, is provided with the vertical bore, and has on its end region which faces the container a guide element for protecting the vertical bore from the entry of liquid from the liquid guidance conduit, with a pressurized gas and return gas conduit being associated with the vertical bore, it is proposed pursuant to a further embodiment of the present invention that this extension be embodied as a gas conduit, the inside passage of which forms the vertical bore that end region of the gas conduit that faces the container is provided with a swirl-producing guide element that is adapted to the liquid guidance conduit. That end of the gas conduit that is remote from the container is provided with a threaded extension so that it can be screwed into the lower part of the filling element. Provided in the lower part of the filling element, adjoining the thread for receiving the threaded extension, is a widened portion into which open the vertical bore and the pressurized gas and return gas conduit that extends in the lower part. The widened portion adjoins a holder that extends coaxial to the vertical bore, and into which the signal emitter is sealingly inserted in such a way that its effective sensing surface faces that vertical bore.

For a filling element having a valve body that is movable up and down for the liquid flow valve disposed in a body of the filling element, and having an upper cover for the filling element body, whereby the valve body is provided with a pressurized gas valve at its upper end region, and with an extension that passes through the liquid guidance conduit and acts as a guide element at its lower end region, and whereby the vertical bore passes through the extension and the valve body, it is proposed pursuant to a further advantageous embodiment of the present invention that the extension be embodied as a gas conduit, the inside passage of which forms the vertical bore, and that the end region of the gas conduit facing the container be provided with a swirl-producing guide element that is adapted to the liquid guidance conduit; the signal emitter is disposed above the container end of the vertical bore and maintains an annular gap in the latter.

It was surprisingly discovered that the inside passage, in the form of the vertical bore, required for supplying gas into, and/or for withdrawing gas from, a pressed-on container, simultaneously also has adequate dimensions in order, for detecting the designated filling height in the container, to emit pulses, and receive reflected pulses, from a measuring device, via the vertical bore into the pressed-on container. It is therefore now possible to eliminate the signal emitter that up to now had to be introduced into the container that was being filled, and, where the designated filling height was being changed, had to be exchanged or adjusted on the filling element. Such changes of the designated filling height previously always led to an interruption in production of the filling machines, which are equipped with a plurality of filling elements. A further advantage of the present invention is that the expense and complexity previously required for the exchange or adjustment of height of the signal emitter on the filling element are avoided, so that not only are the manufacturing costs for each filling element considerably reduced, but at the same time the functional reliability is also considerably increased. The latter is due to the inventive placement of the signal emitter above that region of the filling element where the container is pressed on, and that comes into contact with a container that is to be filled, as a result of which the signal emitter is protected from bursting and inadequately centered containers, and is thus protected from damage and hence from inefficient functioning. Finally, because a measuring system that operates in a non-contact manner is proposed for detecting the designated filling height, the present invention precludes, for example, that inadequately cleaned containers that are infected with germs which are harmful to beverages, and that are supplied to the filling element, can infect the signal emitter, via the liquid supplied to the container, with the result that the contents of the container filled with the infected filling element will keep for only a short period of time.

Further specific features of the present invention will be described in detail subsequently.

DESCRIPTION OF PREFERRED EMBODIMENTS

Referring now to the drawings in detail, the embodiment illustrated in FIG. 1 shows a filling element 10 that has no filling tube and is designed for single-chamber counter pressure filling machines. Several of such filling elements 10 of circulating filling machines (not illustrated in greater detail) are disposed about an annular liquid chamber 11 that contains liquid and, above the liquid, gas under pressure. Cooperating with each filling element 10 is a lifting mechanism 12 that is mounted in the table of the filling machine, and serves for pressing a bottle or other container onto the filling element. In addition, each filling element 10 has a filling element body 15 that is comprised of a filling element housing 13 and a lower or base part 14. Provided within the filling element housing 13 is a vertical valve body 17 that is biased by an opening spring 16. The valve body 17, via a sealing element provided thereon, is supported against a valve seat 18. The valve body 17 and the valve seat 18 together form the liquid flow valve 19. An electromagnetic or electropneumatic actuating device 21, such as a magnet, is mounted on the filling element housing 13 and acts upon the valve body 17 via a push rod 20. When activated, the actuating device 21 presses the valve body 17, against the opening spring 16, onto the valve seat 18, thus establishing the closed position of the liquid flow valve 19.

A pressurized gas valve arrangement 22 is disposed on the side of the filling element housing 13. By means of a support 25, a valve disk 24 that is in the form of a control disk and is provided with a non-illustrated connecting channel is rotatably disposed in the housing 23 of the valve arrangement 22. The free end of the support 25, which extends out of the housing 23, is provided with an actuating lever 26 that, when the machine rotates, cooperates with control elements 27, such as control cams or sequence switch cams, that are provided at intervals on the frame of the filling machine and are disposed in different planes, in order via this cooperation to turn the valve disk 24 into that operating position desired at any given time. A spring 28 presses the valve disk 24 in a gas tight manner against a base plate 29. The pressurized gas and return gas conduit 31, which comes from the pressurized gas region 30 of the liquid chamber 11, and which is guided through the wall of the latter and through the filling element housing 13, opens in that surface of the base plate 29 that faces the valve disk 24. Also opening in that surface of the base plate 29 that faces the valve disk 24 are a pressurized gas and return gas conduit 32, which extends in the filling element housing 13 and in the lower part 14 and leads to the press-on region of the filling element 10, as well as a relief or by-pass conduit 33 that is guided in the base plate 29 to the outside.

Figure 2:
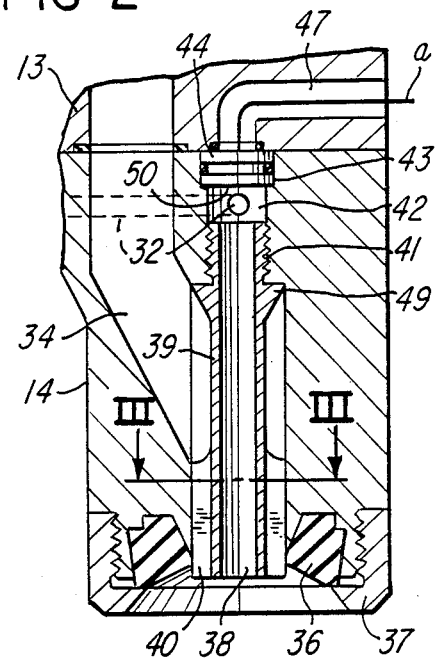
FIG. 2 is an enlarged view of the lower portion of the filling element of FIG. 1.
Figure 3:
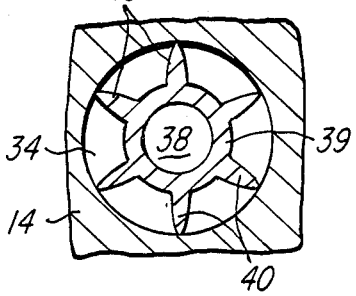
FIG. 3 is a cross-sectional view through the swirl-producing guide element, and is taken along the line III—III in FIG. 2.

Extending downwardly from the valve seat 18 of the liquid flow valve 19 is a liquid guidance conduit 34 that opens at that end of the filling element body 15 that is formed by that end of the lower part 14 which faces the bottle or other container 35 that is to be filled. This opening of the liquid guidance conduit 34 at that end of the lower part 14 which faces the container 35 is concentrically surrounded by the container seal 36 of the filling element. A container-centering element 37 that is exchangeably screwed to the lower part 14 is associated directly below the container seal 36. That section of the liquid guidance conduit 34 that extends vertically in the lower prt 14 passes through the center portion of an extension that has a vertical bore 38 (see FIG. 2). This extension forms a gas conduit 39, the inside passage of which forms the vertical bore 38. The gas conduit 39 ends in the region of the opening of the liquid guidance conduit 34, and in this end region, which faces a container, is provided with a swirl-producing guide element 40 in the form of a multiple thread, for example a modified V thread having a steep pitch. The outer diameter of the guide element 40 is adapted to the inside diameter of the liquid guidance conduit 34, and the inner diameter of the guide element 40 is adapted to the outer diameter of the gas conduit 39 (see FIG. 3). However, in place of the swirl-producing guide element 40, it would also be possible to provide a conventional deflector or similar guide element that is disposed at the lower end of the gas conduit 39 and that similarly deflects the liquid that is flowing down in the liquid guidance conduit 34 from that end of the vertical bore 38 that faces a container 35 that is to be filled toward the inner wall of such a container, thus keeping the central bore 38 free from liquid. Finally, a threaded extension 41 is formed at the upper end of the gas conduit 39 on an abutment collar 49 that is provided with a seal. In this way the gas conduit 39 can be screwed into an upper threaded bore of the lower part 14, and can be tightly drawn against the abutment collar 49. Adjoining the upper end of the gas conduit 39, in the lower part 14, is a widened portion 42 into which open the vertical bore 38 and the pressurized gas and return gas conduit 32.

The top of the widened portion 42 leads into a holder 43 that ends at the top of the lower part 14, which rests against the underside of the filling element housing 13, and is mounted concentric to the vertical bore 38. Accommodated in the holder 43 is a signal emitter 44 or sensor, the effective sensing surface 50 of which faces the widened portion 42, and the ineffective upper surface, or signal output side, of which faces the underside of the filling element housing 13. The signal emitter 44 is part of a measuring device 45 that is designed to detect the designated filling height in the container that is to be filled in a non-contact manner. To detect the designated filling height, the measuring device 45, via the signal emitter 44, transmits or sends pulses through the vertical bore 38 in the gas conduit 39 into the container 35 that is pressed agains the container seal 36. The measuring device 45 evaluates pulses reflected from the liquid level that is rising in the container 35, and when the designated filling height is detected, generates an electrical signal to regulate the actuating device 21. The measuring device 45 can be designed for an ultrasonic measuring method, or for a light-measuring method that uses visible or invisible light. In the embodiment illustrated in FIG. 1, the measuring device 45 operates pursuant to the ultrasonic measuring method, with that portion of the measuring device 45 that comprises the signal emitter 44 being associated with the filling element 10, and with the remaining further portion 46 of the measuring device 45 being protected from moisture and being centrally disposed on the upper portion of the filling machine, which portion supports the liquid chamber 11. The signal emitter 44 of the respective filling element 10 of the filling machine is embodied as a transducer or converter, and is connected to the signal input side of the further portion 46, which is provided for all of the filling elements 10 of the filling machine, via a signal line "a" that is connected to the signal output side of the emitter 44, is conveyed to the outside through a channel 47 in the filling element housing 13, and is protected from damage outside the filling element 10. It would also be possible to provide separate further portions 46 for each filling element 10. In the illustrated embodiment, the further portion 46 that is provided in common for all of the filling elements 10 of the filling machine is provided in a known manner (therefore this feature is not illustrated) with an operational arrangement "operation control" that essentially incorporates a transmitter for the ultrasonic pulses that are to be transmitted by the signal emitter 44, a receiver for the electrical signals that are given off by the signal emitter 44 in response to echo pulses that are received, one or more amplifiers, and a desired filling height value adjuster 48 for the designated filling height, such as a programmed insert. In the modified embodiment of FIG. 4, the measuring device 45 operates pursuant to the light-measuring method, the further portion 46 is formed from a known light sensor, the sensing surface 50 of the signal emitter 44 of the measuring device 45 is formed from the end of a photoconductor to transmit the light pulses and from the end of a photoconductor to receive the reflected light pulses, and transmitting as well as receiving from the photoconductors are combined into an essentially circular, flexible line 51. When the designated filling height is detected, the output signal of the further portion 46 of the measuring device 45 that is emitted can be completed in a control unit 52, for example a data-processing device, which is similarly disposed on the upper portion of the filling machine. After completing programmed requirements, the control unit 52 processes the output signal that is associated with each filling element 10 of the filling machine to a control signal. Via the non-illustrated output control of the unit 52, this control signal is conveyed over the signal line "b" to the actuating device 21 of that filling element 10 from which the output signal originates. If a separate measuring device 45 is provided for each filling element 10, then a control unit 52 of the switching relay type can be connected to the signal output of the further portion 46, with the signal line "b" of the actuating device 21 being disposed on the output side of the control unit 52.

Prior to beginning the filling process, the phases of which that are essential for a further explanation of the invention will be subsequently described, the filling element 10 has the starting position that is illustrated in FIG. 1. The container 35, such as a bottle, that is to be filled is tightly pressed against the container seal 36 of the filling element 10 by a lifting mechanism 12. The operational electromagnetic actuating device 21 holds the liquid flow valve 19 in a closed position against the action of the opening spring 16. Furthermore, the connection of the conduits 31 and 32 is interrupted by the valve disk 24, which is in a neutral position, and the designated filling height is set for all of the filling elements 10 of the filling machine via a central desired filling height value adjuster 48, for example a switching point of switching region on the further portion 46 of the measuring device 45. After the valve disk 24 turns as a result of the rotation of the filling machine, and as the actuating lever 26 contacts the control element 27 of the machine frame provided for pressurizing of the container, the pressurizing of the container 35 is introduced from the gas region 30 of the liquid chamber 11 via the conduits 31, 32 (which are interconnected by this turning movement via the non illustrated connection channel of the valve disk 24), the widened portion 42, and the central bore 38 of the gas conduit 39. When pressure equalization is achieved between a continuously pressed-on container 35 and the liquid chamber 11, and when shortly thereafter the electromagnetic actuating device 21 is switched into an inoperative position by the control unit 52, the opening spring 16 moves the valve body 17 upwardly, so that the liquid flow valve 19 is opened and the liquid from the liquid chamber 11 can flow through the open liquid guidance conduit 34 and the swirl-producing guide element 40 into the passageway of the container seal 36 and thereupon along the inner wall of the container 35 into the latter. While maintaining the turned position of the valve disk 24, the return gas expelled from the container 35 as liquid flows therein is conveyed through the central bore 38, the widened portion 42, and the connected conduits 31, 32 into the pressurized gas space 30 of the liquid chamber 11.

Ultrasonic pulses, e.g. at a frequency of 200 kHz, are emitted by the signal emitter 44 of the measuring device 45 at predetermined time intervals, and are transmitted via the vertical bore 38 into the container 35. The echo pulses reflected from the liquid surface via the vertical bore 38 are received by the signal emitter 44. The received echo pulses are converted by the signal emitter 44 into electrical signals that pass via the signal line "a" into the further portion 46 of the measuring device 45, where they are amplified. When the designated filling height is detected, there appears at the signal output side of the further portion 46 a signal that is scanned by the control unit 52 and, possibly after further processing, is conveyed as a control signal, via the output control, to the actuating device 21, thereby switching the latter into an operative condition. Via the push rod 20, the actuating device 21, against the force of the opening spring 16, now returns the valve body 17, and hence the liquid flow valve 19, to the closed state. The subsequent interruption of the gas connection between the container 35 and the gas region 30 of the liquid chamber 11, and the release of pressure that follows this interruption, are effected by respective turning movements of the valve disk 24, with the connection channel thereof being turned to such an extent that on the one hand the connection between the pressurized gas and return gas conduits 31 and 32 is interrupted, and on the ohter hand the pressurized gas and return gas conduit 32 is connected to the relief conduit 33 to relieve the container 35. After this filling process, and during a signal rotation of the filling element 10, the filled container 35 is withdrawn from the filling element 10 and is transported in the customary manner from the filling machine; in addition, the valve disk 24 is turned back into the neutral starting position.

Figure 5:
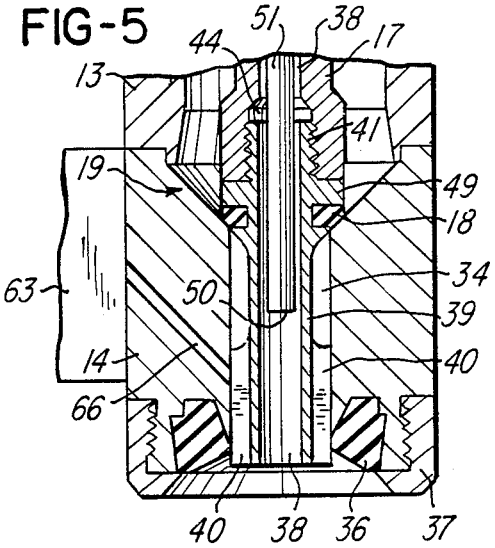
FIG. 5 is an enlarged view of the lower portion of the filling element of FIG. 4.
Figure 4:
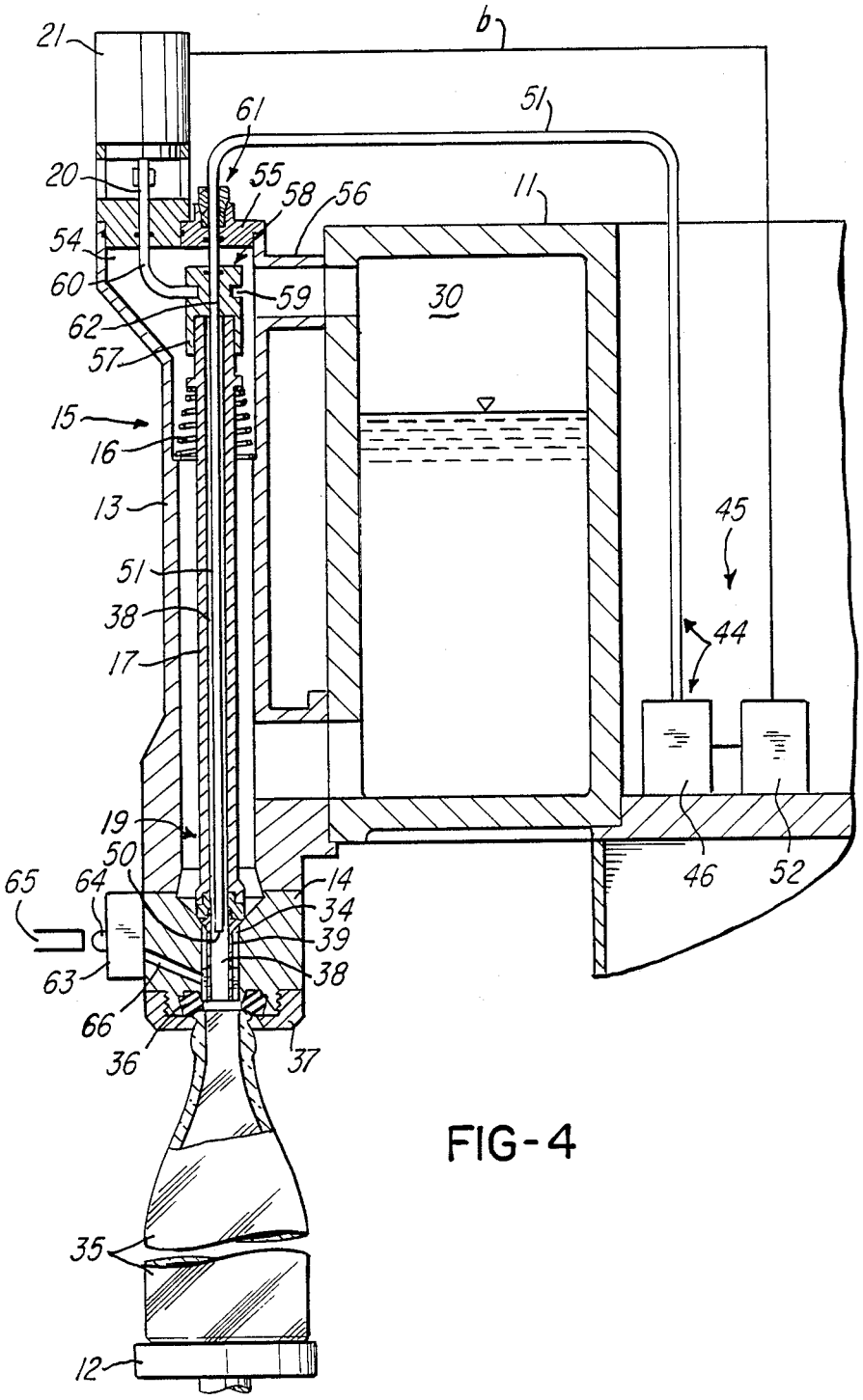
FIG. 4 is a view that shows another exemplary embodiment of the inventive filling element, with a gas conduit disposed on the valve body of the liquid flow valve, and with a measuring device that includes a signal emitter.

In the modified embodiment of the inventive filling element 10 illustrated in FIGS. 4 and 5, the gas conduit 39 is part of the valve body 17 of the liquid flow valve 19. With its threaded extension 41, this gas conduit 39 into a thread is provided therefore in the shank of the valve body 17. Provided in an annular groove 53 of the abutment collar 49 is the seal via which the valve body 17 rests upon the valve seat 18 of the liquid flow valve 19. The vertical bore 38 in the gas conduit 39 extends throughout the entire length of the valve body 17. As a further modification, the valve seat 18 is provided in the lower part 14 of the filling element body 15, and the filling element housing 13 is extended upwardly to provide a gas chamber 54 that is sealingly closed off from the atmosphere by a cover 55. Within the gas chamber 54, which communicates via a connector 56 of the filling element housing 13 with the pressurized gas region 30 of the liquid chamber 11, the pressurized gas valve body 57 of a conventional pressurized gas valve 58 is mounted on the end region of the valve body 17, which extends into the gas chamber 54, in such a way that it can be raised and lowered. The pressurized gas valve 58, along with a relief valve 63 that is mounted on the lower part 14, replace the previous pressurized gas valve arrangement 22. A pronged member 60 that is formed on the push rod 20 of the actuating device 21, which is inserted in the cover 55, engages an annular groove 59 in the pressurized gas valve body 57. The line 51, which has the photoconductor and is part of the measuring device 45, which for the purpose of detecting the designated filling height in a non-contact manner is designed to utilize light pulses, is guided downwardly into the vertical bore 38 of the gas conduit 39 via a holder 61 in the cover 55, and via a through-bore 62 in the pressurized gas valve body 57. An annular gap for the supply and withdrawal of pressurized gas and return gas is maintained between the wall of the vertical bore 38 and the outer periphery of the line 51. In addition, the sensing surface 50 of the line 51 is disposed above the container end of the vertical bore 38. If a measuring device 45 that utilizes ultrasonic pulses is to be provided for this filling element 10, then in place of the line 51 a non-illustrated hollow shaft is provided for that section that extends from the holder 61 into the vertical bore 38 of the gas conduit 39. In this case, that end of the shaft that is within the vertical bore 38 of the gas conduit 39 then carries the signal emitter 44 that has the sensing surface 50, whereas the signal line "b" that is otherwise disposed in the further portion 46 is guided to the outside through the hollow portion of the shaft. Finally, the conventional relief valve 63 that is mounted on the lower part 14 has a valve stem 64 that is actuated by a cam 65 mounted on the machine frame on the filling machine, and that communicates with the atmosphere upon activation of a relief channel 66 that is provided in the lower part 14 and leads to the liquid guidance conduit 34.

In contrast to the preceding description of the operation for the filling element 10 illustrated in FIG. 1, with the previously described filling element modification of FIG. 4, when the actuating device 21 is switched into the non-operative position as a result of pressing the container 35 on, pressurizing of this container is effected in such a way that by means of the pronged member 60 mounted on the push rod 20, the pressurized gas valve body 57 is raised, and hence the valve 58 is opened. This initiates pressurizing of the container 35 from the pressurized gas region 30 of the liquid chamber 11 via the connector 56, the opened pressurized gas valve 58, and the vertical bore 38. When pressure equalization has been achieved between the continuously pressed-on container 35 and the liquid chamber 11, the opening spring 16 moves the valve body 17 upwardly, so that the liquid flow valve 19 is opened and the liquid from the liquid chamber 11 flows into the passage of the container seal 36, and thereupon via the inner wall of the container 35 into the latter, via the opened liquid guidance conduit 34 and the guide element 40. The return gas that is displaced when the liquid flows into the container 35 escapes via the vertical bore 38 and the pressurized gas valve 58 into the gas chamber 54 of the filling element housing 13, and from there via the connector 56 into the pressurized gas region 30 of the liquid chamber 11. Light pulses, such as pulses of invisible light, from the sensing surface 50 of the signal emitter 44 of the measuring device 54, and along the line 51, are transmitted into the container 35 at predetermined time intervals via the vertical bore 38 of the gas conduit 39, which extends below the sensing surface 50; the light pulses reflected from the surface of the liquid are received by the signal emitter 44 via its sensing surface 50 and the line 51. The signal emitter 44 converts the received light pulses into electrical signals that pass into the light sensor which forms the further portion 46 of the measuring device 45. When the designated filling height has been detected, there appears at the signal output side of the further portion 46 a signal that is scanned by the control unit 52 and, possibly after further processing, is conveyed further, via the output control of the unit 52, as a switching or control signal to the actuating device 21, thus switching the latter into the operative position. By means of the push rod 20 and the pronged member 60 secured thereto, the actuating device 21 returns the pressurized gas valve 58 and simultaneously, against the force of the opening spring 16, also the valve body 17 and consequently the liquid flow valve 19 into the closed position. Relief of the container 35 via the relief channel 66 is thereupon effected after the valve stem 64 of the relief valve 63 contacts the cam 65. After this filling process, during a single rotation of the filling element, and after the valve stem 64 leaves the cam 65, the relief valve 63 is closed, and the filled container 35 is removed from the filling element 10 and is transported from the filling machine in a conventional manner.

Figure 6:
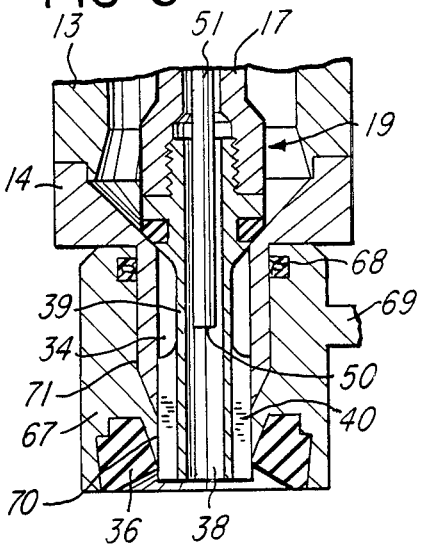
FIG. 6 is a view that shows a lower portion of the filling elements of FIGS. 1 and 4, where the container seal for these filling elements can be raised and lowered.

In the filling elements illustrated in FIGS. 1 and 4, the container seal 36 is fixedly disposed on the respective container-end of the filling element body 15; facing each container seal 36 is a lifting mechanism 12 that is disposed in the table of the filling machine. Pursuant to a further inventive modification, in place of the lifting mechanism 12 and the fixed container seal 36 for each filling element 10, the table of the filling machine can also be provided with a common conventional, non-illustrated ring-shaped shelf-like member can be provided for all of the filling elements 10, and the container seal 36 of each filling element 10 can be accommodated in the bottom end of a sleeve 67 that can be raised and lowered (see FIG. 6). This sleeve 67 is mounted on a connector 71 that is formed on the lower part 14 concentric to the vertical bore 38 of the gas conduit 39; the sleeve 67 and the connector 71 are sealed relative to one another via a grooved ring seal 68. A mechanism 69, which is not shown in any detail, can be attached directly to the sleeve 67 to lower the sleeve 67 from a starting position onto the mouth of a container that is to be filled to press the container seal 36 against the container; after conclusion of the filling process, the mechanism 69 raises the sleeve 67 into the starting position that is illustrated in FIG. 6. However, it would also be possible to embody the sleeve 67 itself as a single or double-acting piston that can be lowered and raised by pneumatic control elements. Furthermore, in the region of the guide element 40 of the gas conduit 39, the liquid guidance conduit 34 is divided into an upper region associated with the connector 71, and a lower region that is associated with the sleeve 67 and is in the form of an annular passage 70, so that in the lowered position of the sleeve 67, the liquid supplied via the liquid guidance conduit 34 when the liquid flow valve 19 is opened passes reliably via the annular passage 70 and the container seal 36 to the inner wall of the pressed-on container 35, and the container end of the vertical bore 38 remains free of liquid.

The invention as described is not limited to filling elements without filling tubes for the aforementioned single-chamber counter pressure filling machines. Rather, the present invention is also intended for the filling elements of multi-chamber counter pressure filling machines, as well as for filling elements of filling machines where filling is accomplished at atmospheric pressure or at a partial vacuum.

The present invention is, of course, in no way restricted to the specific disclosure of the specification and drawings, but also encompasses any modifications within the scope of the appended claims.

What we claim is:

1. A filling element, said filling element including a liquid flow valve, said filling element including a vertical bore therein, said filling element having no filling tube, said filling element being adapted to fill a container such as a bottle, can, or narrow-neck vessel, said filling element being adapted to fill the container with liquid to a designated filling height in the container, said filling element being adapted to have the container pressed thereon during the filling operation, said filling element being adapted to seal-off the container during the filling operation, said filling element including a measuring device, said measuring device including a signal emitter for detecting the designated filling height in the container when the container is pressed on said filling element, said signal emitter being adapted to cooperate operatively with said vertical bore, said filling element including a container seal, said container seal being provided with a centering device, said signal emitter being aligned coaxially with said vertical bore and said container seal, said filling element including a liquid guidance conduit, said signal emitter being protected from entry of liquid from said liquid guidance conduit, and said measuring device being adapted to transmit a signal to trigger closing of said liquid flow valve when said designated filling height is detected;

said measuring device, in order to detect said designated filling height in a non-contact manner, being embodied to operate with said signal emitter being arranged externally of the container being filled so that pulses are directed onto the surface of liquid in the container when the container is pressed on the filling element, to thereby avoid the danger of infection; and said vertical bore having an end, said end being adapted to face the container when the container is pressed on the filling element, said signal emitter being disposed above said end, said vertical bore being adapted for use by said signal emitter to react to said designated filling height, said vertical bore being adapted to supply gas to, and withdraw gas from, the container when the container is pressed on the filling element.

2. A filling element according to claim 1, in which said measuring device, in order to effect said detection of said designated filling height in a non-contact manner, is embodied to operate with ultrasonic pulses.

3. A filling element according to claim 1, in which said measuring device, in order to effect said detection of said designated filling height in a non-contact manner, is embodied to operate with light pulses.

4. A filling element according to claim 3, in which said measuring device is a light sensor, the signal emitter of which includes a first photoconductor for emitting said light pulses, and a second photoconductor for receiving reflected light pulses, with said two photoconductors being formed into a flexible and essentially circular line that has a sensing surface.

5. A filling element according to claim 4, in which said sensing surface of said line is disposed within said vertical bore, with an annular gap being maintained between the latter and said line.

6. A filling element according to claim 4, in which said sensing surface of said line is associated with, and is disposed above, said vertical bore.

7. A filling element according to claim 1, which includes an extension that is embodied as a first gas conduit and is fixedly disposed in said liquid guidance conduit, said gas conduit having an inside passage that forms said vertical bore, and having an end that faces the container when the container is pressed on the filling element, this end being provided with a swirl-producing guide element that is adapted to said liquid guidance conduit to effect said protection; a pressurized gas and return gas conduit is provided in said filling element and communicates with said vertical bore; said first gas conduit also has an opposite upper end, remote from the container when the container is pressed on the filling element, that is provided with a threaded extension to allow said first gas conduit to be screwed into a threaded portion of said filling element; a widened portion adjoins said threaded portion, in said filling element, remote from the container when the container is pressed on the filling element, with said pressurized gas and return gas conduit, and said vertical bore, opening into said widened portion; adjoining said widened portion, in said filling element, is a holder that extends coaxial to said vertical bore; and in which said signal emitter has an effective sensing surface and is sealingly disposed in said holder in such a way that said effective sensing surface is directed toward said vertical bore.

8. A filling element according to claim 1, which has a body in which said liquid flow valve is disposed, with the latter having a valve body that can be moved up and down; said filling element body is provided with an upper cover, and said valve body has an upper end region, which is provided with a pressurized gas valve, and a lower end region, which is provided with an extension, in the form of a gas conduit, that passes through said liquid guidance conduit, with said vertical bore extending through said gas conduit and said valve body; said gas conduit has an inside passage that forms the pertaining part of said vertical bore; said gas conduit has an end that faces the container when the container has been pressed on the filling element, this end being provided with a swirl-producing guide element that is adapted to said liquid guidance conduit; and in which said signal emitter is disposed above the container end of said vertical bore in such a way that an annular gap is maintained in said vertical bore.

9. A filling element according to claim 8, in which said valve body has a shaft that is threadedly connected with said gas conduit; to effect this connection, said gas conduit has an upper end region, remote from the container when the container has been pressed on the filling element, that is provided with an abutment collar, adjoining which, on a side thereof remote from the container when the container has been pressed on the filling element, is a threaded extension that allows said gas conduit to be screwed into said shaft of said valve body; and said filling element has a valve seat for said valve body of said liquid flow valve, with said abutment collar being provided with an annular groove for a sealing element that serves to support said valve body against said valve seat.

10. A filling element according to claim 8, which includes a shaft that extends, from the outside, into said hollow bore of said gas conduit through a holder, which is sealingly disposed on said upper cover, and a through-bore of the body of said pressurized gas valve, with said signal emitter being secured to a lower end of said shaft, remote from said upper cover; said filling element has a gas chamber that is sealed off relative to the atmosphere by a sealing member of said holder; and said pressurized gas valve body freely movably and sealingly disposed on said shaft.

11. A filling element according to claim 10, in which said measuring device is a light sensor, the signal emitter of which includes photoconductors that are formed into a line which forms said shaft.

12. A filling element according to claim 8, in which said liquid guidance conduit has an end region that cooperates with said swirl-producing guide element of said gas conduit, with said end region communicating with an annular passage of a sleeve that is disposed on said filling element body in such a way that it can be raised and lowered; said sleeve has an end that faces the container when the container has been pressed on the filling element and is provided with said container seal; said end region of said liquid guidance conduit is sealed off relative to the atmosphere via a grooved ring seal disposed within said sleeve.

* * * * *